US008894385B2

(12) United States Patent
Goss et al.

(10) Patent No.: US 8,894,385 B2
(45) Date of Patent: Nov. 25, 2014

(54) BI-DIRECTIONAL PUMP

(75) Inventors: Ryan P. Goss, Silvis, IL (US); Lourens M. Jacobs, Cedar Falls, IA (US)

(73) Assignee: Deere & Company, Moline, IL (US)

( * ) Notice: Subject to any disclaimer, the term of this patent is extended or adjusted under 35 U.S.C. 154(b) by 516 days.

(21) Appl. No.: 13/298,346

(22) Filed: Nov. 17, 2011

(65) Prior Publication Data

US 2013/0126024 A1 May 23, 2013

(51) Int. Cl.

| | |
|---|---|
| ***F04C 14/04*** | (2006.01) |
| ***F04C 28/04*** | (2006.01) |
| ***F04C 15/06*** | (2006.01) |
| ***F04C 14/10*** | (2006.01) |
| *F04C 2/14* | (2006.01) |

(52) U.S. Cl.

CPC ..... *F04C 14/04* (2013.01); *F04C 2240/30* (2013.01); *F04C 2/14* (2013.01); *F04C 15/064* (2013.01); *F04C 14/10* (2013.01)

USPC ..... 417/315

(58) Field of Classification Search

CPC ..... F04C 14/04; F04C 14/12

USPC ..... 417/315, 410.3, 410.4; 418/32

See application file for complete search history.

(56) References Cited

U.S. PATENT DOCUMENTS

| | | | | |
|---|---|---|---|---|
| 4,874,298 | A * | 10/1989 | Mainardi et al. | 417/315 |
| 4,900,235 | A * | 2/1990 | Perkins et al. | 417/315 |
| 5,586,862 | A * | 12/1996 | Danner | 415/146 |
| 2007/0113703 | A1 | 5/2007 | Himmelmann | |
| 2009/0072617 | A1 | 3/2009 | Alfthan | |
| 2010/0193714 | A1 | 8/2010 | Hankinson et al. | |

FOREIGN PATENT DOCUMENTS

| | | |
|---|---|---|
| CN | 201344124 | 11/2009 |
| EP | 2154372 | 2/2010 |

* cited by examiner

*Primary Examiner* — Bryan Lettman

(57) ABSTRACT

A bi-directional pump comprises a pump housing, and the pump housing comprises a pump outlet. A fluid pressurizer is positioned in the pump housing and configured to provide fluid flow selectively in a first direction and a second direction. A first passage and a second passage are positioned in the pump housing. A junction is fluidly positioned, in the pump housing, connecting the first and second passages to the pump outlet. A flow controller is positioned in the pump housing to move relative thereto, between a first position, placing the first passage, in fluid communication, with the pump outlet via the junction when the fluid pressurizer provides fluid flow in the first direction, and a second position placing the second passage, in fluid communication with the pump outlet, via the junction when the fluid pressurizer provides fluid flow in the second direction.

17 Claims, 7 Drawing Sheets

BI-DIRECTIONAL PUMP

FIELD OF THE DISCLOSURE

The present disclosure relates to a bi-directional pump. More specifically, the present disclosure relates to a bi-directional pump having a uni-directional output flow.

BACKGROUND OF THE DISCLOSURE

In vehicles having transmissions composed of complex mechanical systems, it is necessary to lubricate moving parts of the vehicle for dissipating heat and facilitating smooth operation. It is convenient to utilize the power generated by the already moving parts of the transmission to drive pumps that provide lubrication to the transmission or, for example, a power takeoff system. The pumps must provide continuous lubrication to the moving parts for all operative modes of the transmission. If the transmission operates in both forward and reverse directions, known pumps running off of the transmission will direct lubrication toward the moving parts in the forward direction, but the pump will draw lubrication away from the moving parts in the reverse direction.

As such, a second pump system may be implemented with reverse gearing for providing lubrication to the moving parts in the reverse direction. Alternatively, complex valve systems that are distinct from the pump may be added thereto to reroute the lubrication flow toward the moving parts in the reverse direction. Or, alternatively, a gear and a clutch cluster may convert a bi-directional input to a uni-directional output for driving the pump. Adding additional pumps, valve systems, or gear and clutch clusters adds complexity and costs to the mechanics of the lubrication system. What is needed is a simple, affordable bi-directional pump having a uni-directional output flow.

SUMMARY OF THE DISCLOSURE

According to the present disclosure, a bi-directional pump is provided. The bi-directional pump comprises a pump housing, and the pump housing comprises a pump outlet. A fluid pressurizer is positioned in the pump housing and configured to provide fluid flow selectively in a first direction and a second direction. A first passage and a second passage are positioned in the pump housing. A junction is fluidly positioned, in the pump housing, connecting the first and second passages to the pump outlet. A flow controller is positioned in the pump housing to move relative thereto, between a first position, placing the first passage, in fluid communication, with the pump outlet via the junction when the fluid pressurizer provides fluid flow in the first direction, and a second position placing the second passage, in fluid communication with the pump outlet, via the junction when the fluid pressurizer provides fluid flow in the second direction. The disclosed bi-directional pump provides a uni-directional output flow, and it is simple and cost effective.

BRIEF DESCRIPTION OF THE DRAWINGS

The detailed description of the drawings refers to the accompanying figures in which.

DETAILED DESCRIPTION OF THE DRAWINGS

Figure 1:
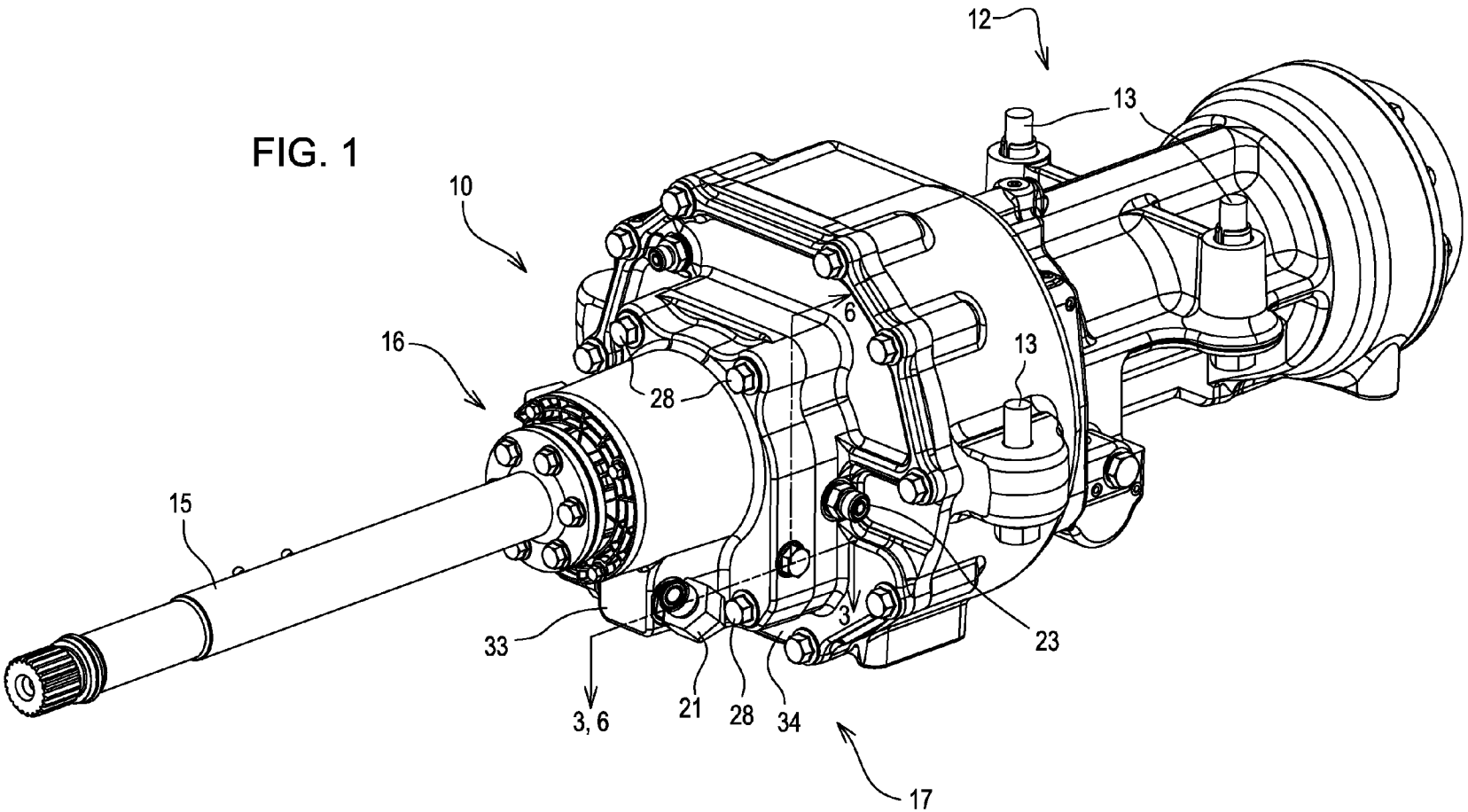
FIG. 1 is a perspective view showing a bi-directional pump mounted to, for example, a front power takeoff.
Figure 2:
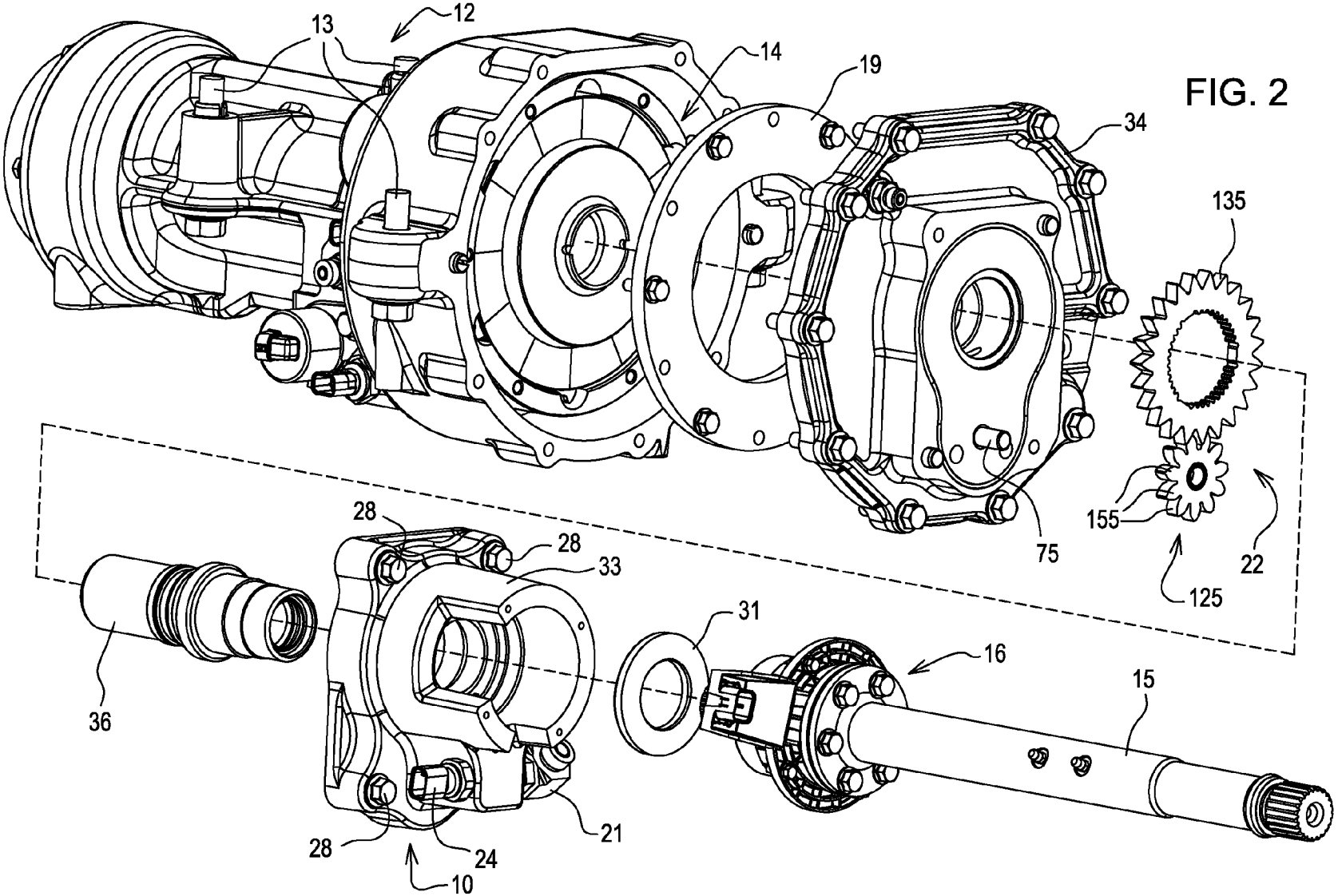
FIG. 2 is an exploded view of the bi-directional pump and the front power takeoff of FIG. 1.
Figure 3:
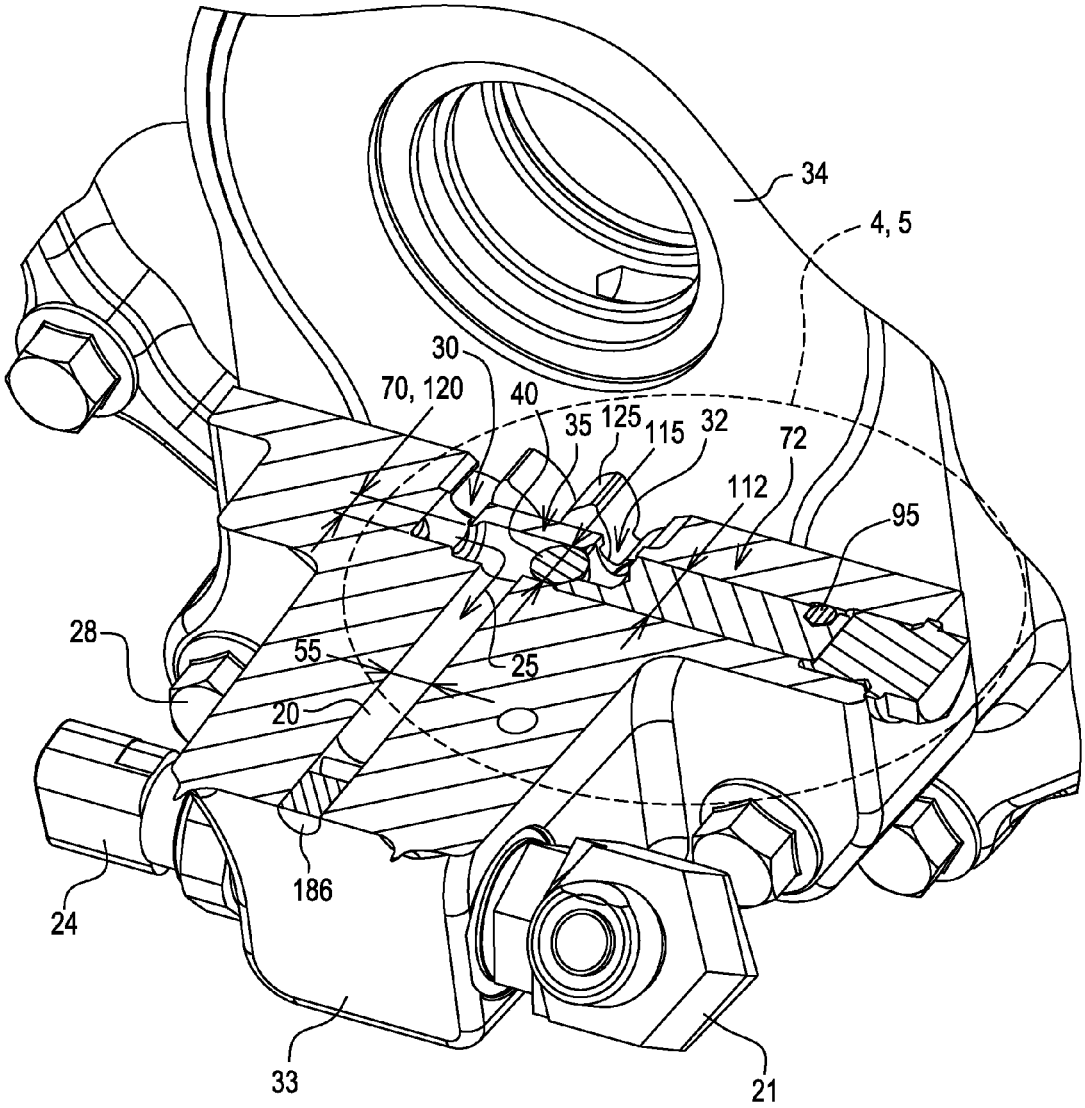
FIG. 3 is a perspective view of the pump housing, along lines 3-3 of FIG. 1, showing a first passage and a second passage and a junction connecting the first and second passages to a pump outlet, and further showing the flow controller in a first position.

Referring to FIG. 1 through FIG. 3, there is shown a bi-directional pump 10 mounted to, for example, a front power takeoff 12, and the bi-directional pump 10 may, additionally, be connected to a torque sensor 16 and an input shaft 15. A dust seal 31 may be position on the bi-directional pump 10 and, further positioned about the torque sensor 16. The front power takeoff 12 may be mounted to a work machine (not shown), such as an agricultural tractor, via a plurality of fasteners 13. A clutch ring may mount a clutch pack 14 to the front power takeoff 12 for engaging and disengaging the front power takeoff 12. The front power takeoff 12 may provide rotational power to an implement (not shown), such as a mower or a snow blower, for example.

The bi-directional pump 10 comprises a pump housing 17, and the pump housing 17 comprises a pump inlet 18 (see FIG. 7) and a pump outlet 20. Exemplarily, the pump housing 17 comprises a first housing section 33 and a second housing section 34 that mates thereto via a plurality of fasteners. In the embodiment shown, the pump outlet 20 is shown as a plurality of bores and is fluidly connected to an outlet fitting 21 positioned on the pump housing 17. The outlet fitting 21 may be fluidly connected to the transmission via a line (not shown). A plug 186 may seal the pump outlet 20. Exemplarily, a fitting 23 and a pressure transducer 24 may also be positioned on the pump housing 17. The fitting 23 may also be fluidly connected to the transmission via a line (not shown). A fluid pressurizer 22 is positioned in the pump housing 17 and configured to provide fluid flow selectively in a first direction 25 (see FIG. 4) and a second direction 27 (see FIG. 5).

Referring to FIG. 3 through FIG. 7, a first passage 30 and a second passage 32 are positioned in the pump housing 17. A junction 35 is fluidly positioned, in the pump housing 17, connecting the first and second passages 30, 32 to the pump outlet 20. A flow controller 40 is positioned in the pump housing 17 to move relative thereto. The flow controller 40 moves between a first position 42 (see FIGS. 3 and 4) placing the first passage 30, in fluid communication, with the pump outlet 20 via the junction 35 when the fluid pressurizer 22 provides fluid flow in the first direction 25, and a second position 45 (see FIG. 5) placing the second passage 32, in fluid communication with the pump outlet 20, via the junction 35 when the fluid pressurizer 22 provides fluid flow in the second direction 27. Illustratively, the flow controller 40 is shown as a sphere, but the flow controller 40 may also be, for example, a cylinder.

The flow controller 40 may be positioned, on a first side 47 of the junction 35, when the flow controller 40 is in the first position 42, and the flow controller 40 may be positioned, on a second side 50 of the junction 35, when the flow controller 40 is in the second position 45. The flow controller 40 may shuttle between the first and second positions 42, 45. An outer diameter 52 of the flow controller 40 may greater than an inner diameter 55 of the pump outlet 20.

The first passage 30 may comprise a first passage bend 57, and a first passage aperture 60 opening into the first passage bend 57, and a first travel limiter 62. The first travel limiter 62 may be configured to limit the travel of the flow controller 40 so as to space the flow controller 40 from the first passage aperture 60. The first travel limiter 62 may be a first limiter shoulder 65. The outer diameter 52 of the flow controller 40 may be greater than an inner diameter 70 of the first limiter shoulder 65.

The bi-directional pump 10 may further comprise a second travel limiter 72 that is distinct from the pump housing 17. The second passage 32 may comprise a second passage bend 77 and a second passage aperture 80 opening into the second passage bend 77. The second passage bend 77 may be included in the second travel limiter 72, and the second travel limiter 72 may be configured to limit the travel of the flow controller 40 so as to space the flow controller 40 from the second passage aperture 80. Illustratively, the second travel limiter 72 is in alignment with the junction 35, but in other embodiments, the second travel limiter 72 may be perpendicular to the junction 35 or any angle in between.

The second travel limiter 72 may comprises a second limiter shoulder 66 having an inner diameter 82 smaller than the outer diameter 52 of the flow controller 40. The second travel limiter 72 may comprise a first limiter aperture 87 and a second limiter aperture 90. The second passage bend 77 may be positioned between the first and second limiter apertures 87, 90. The pump housing 17 may comprise a bore 92, and the bore 92 may comprise a portion of the first passage 30 and of the second passage 32 and of the junction 35. The bore 92 may comprise the first travel limiter 62.

The bi-directional pump 10 may further comprise a key 95. The second travel limiter 72 may comprise a limiter keyway 97, and the pump housing 17 may comprise a pump housing keyway 100. The key 95 may be positioned in the limiter keyway 97 and in the pump housing keyway 100. The bore 92 has a bore axis 102, and the key 95 may angularly align the first limiter aperture 87 with the second passage aperture 80 relative to the bore axis 102.

The bore 92 may comprise a stop 105. The stop 105 may contact the second travel limiter 72 thereby axially aligning the first limiter aperture 87 with the second passage aperture 80 relative to the bore axis 102. A plug 170 may retain the second travel limiter 72 against the stop.

The second travel limiter 72 may be positioned in the bore 92. The bore 92 may comprise a second travel limiter portion 107 and a junction portion 110 in alignment with the second travel limiter portion 107. The second travel limiter 72 may be positioned in the bore 92 or, more specifically, in the second travel limiter portion 107. The junction portion 110 may be included in the junction 35. A diameter 112 of the second travel limiter portion 107 may be greater than a diameter 115 of the junction portion 110.

The bore 92 may further comprise a first passage portion 117 that is in alignment with the junction portion 110. The junction portion 110 may be positioned between the second travel limiter portion 107 and the first passage portion 117. The first passage portion 117 may be included in the first passage 30. The diameter 115 of the junction portion 110 may be greater than a diameter 120 of the first passage portion 117. The flow controller 40 may be positioned in the junction portion 110. Illustratively, the junction portion 110 and the pump outlet 20 cooperate to for a "T" shape, but the junction portion 110 and the pump outlet 20 may join together at various other angles as well.

Figure 7:
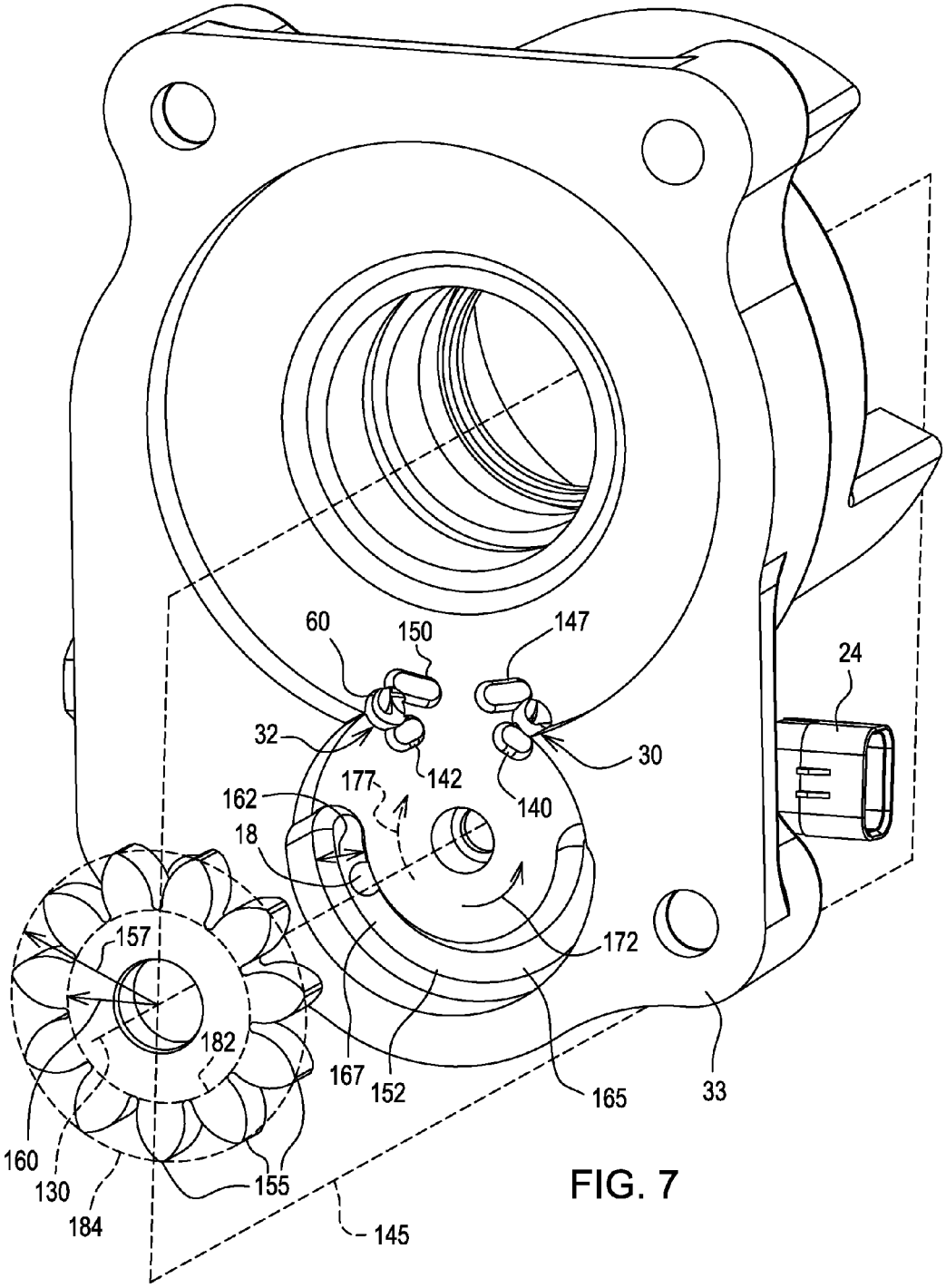
FIG. 7 is an exploded, perspective view of a cavity, first inner and outer recesses, second inner and outer recesses, and a gear.

As shown, in FIGS. 2 and 7, the fluid pressurizer 22 may comprise a gear 125 mounted to rotate relative to the pump housing 17 about a rotation axis 130. The gear 125 may rotate about a gear shaft 75, and a bearing (not shown) may be positioned between the gear 125 and the gear shaft 75. The gear 125 is positioned axially from the first and second passages 30, 32 relative to the rotation axis 130, and the gear 125 may overlap the first and second passages 30, 32 axially relative to the rotation axis 130. In the embodiment shown, the fluid pressurizer 22 also comprises a second gear 135, in mesh with the gear 125, and the second gear 135 drives the gear 125. The second gear 135 may be driven by a pump shaft 36, and the pump shaft 36 may connect to the torque sensor 16.

The pump housing 17 may comprise a first radially inner recess 140 positioned contiguously with the first passage 30, and a second radially inner recess 142 positioned contiguously with the second passage 32. The first radially inner recess 140 may be symmetric to the second radially inner recess 142 about a plane 145 that encompasses the rotation axis 130. Further, the pump housing 17 may comprise a first radially outer recess 147 positioned contiguously with the first passage 30, and a second radially outer recess 150 positioned contiguously with the second passage 32. The second radially outer recess 150 is symmetric to the first radially outer recess 147 about the plane 145.

The pump housing 17 may comprise a cavity 152 that is adjacent to a set of gear teeth 155 of the gear 125. A fluid, such as hydraulic oil, may be used to cool and lubricate the clutch pack 14 (see FIG. 2) of the front power takeoff 12. After the fluid performs these functions, the bi-directional pump 10 may pump the fluid from the cavity 152.

The set of gear teeth 155 has an addendum radius 157 and a dedendum radius 160, and the cavity 152 may have a width 162 approximately equal to a difference between the addendum radius 157 and the dedendum radius 160. As shown, in FIG. 7, the dedendum radius 160 extends from the rotation axis 130 to the dedendum 182, and the addendum radius 157 extends from the rotation axis 130 to the dedendum 184. The cavity 152 may extend approximately 180 degrees relative to the rotation axis 130. The cavity 152 may comprise a first section 165 and a second section 167. The first and second sections 165, 167 may be symmetric to one another about the plane 145 that encompasses the rotation axis 130.

In operation, fluid (e.g., hydraulic oil) flows out of the transmission and into front power takeoff 12. In the front power takeoff 12, the fluid cools and lubricates the clutch pack 14. Then, the fluid flows out of the front power takeoff 12 and into the cavity 152. If the gear 125 rotates, in the first direction 172, then it pumps fluid from the cavity 152 and into the first passage 30. The first radially inner and outer recesses 140, 147 may reduce noise that the gears 125, 135 make as the result of pumping the fluid.

Figure 4:
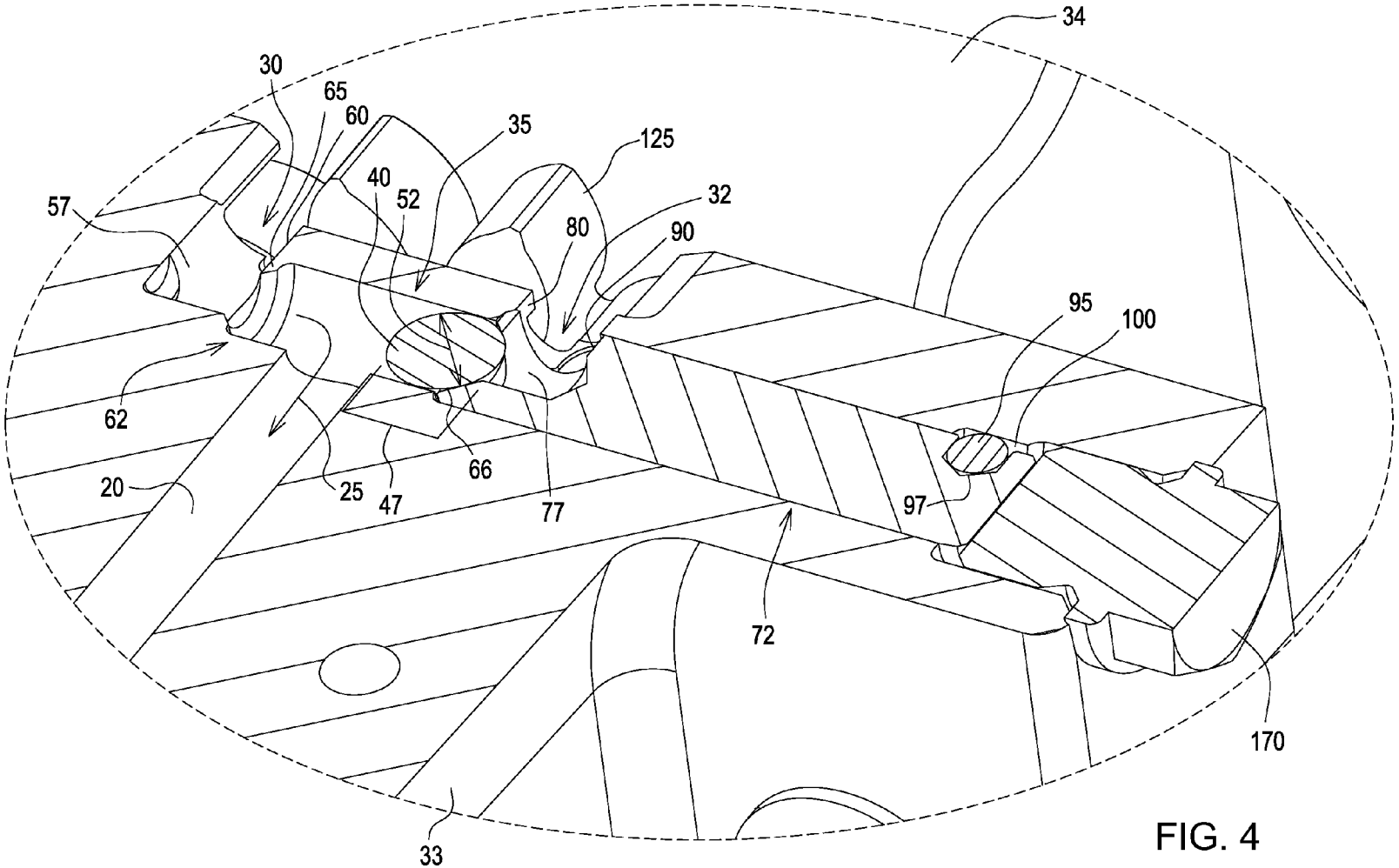
FIG. 4 is enlarged view of region 4, 5 of FIG. 3 showing the first and second passages, the junction, first and second travel limiters, and the flow controller in the first position.

In the embodiment shown, as the fluid flows in the first direction 25, the flow controller 40 is positioned, in the pump housing 17, in the first position 42 (see FIGS. 3 and 4). The junction 35 fluidly connects the first passage 30 and the pump outlet 20. Additionally, this prevents the first passage 30 from being in fluid communication with the second passage 32, because the flow controller 40 and the second limiter shoulder 66 cooperate to form a seal between the first and second passages 30, 32. Illustratively, the pump outlet 20 is fluidly connected to an outlet fitting 21, and the outlet fitting 21 is fluidly connected to a line that returns the fluid to the transmission.

If the gear 125 rotates in the second direction 177, then it pumps fluid from the cavity 152 and into the second passage 32. The second radially inner recess and outer recesses 142, 150 may reduce noise that the gears 125, 135 make as the result of pumping the fluid.

Figure 5:
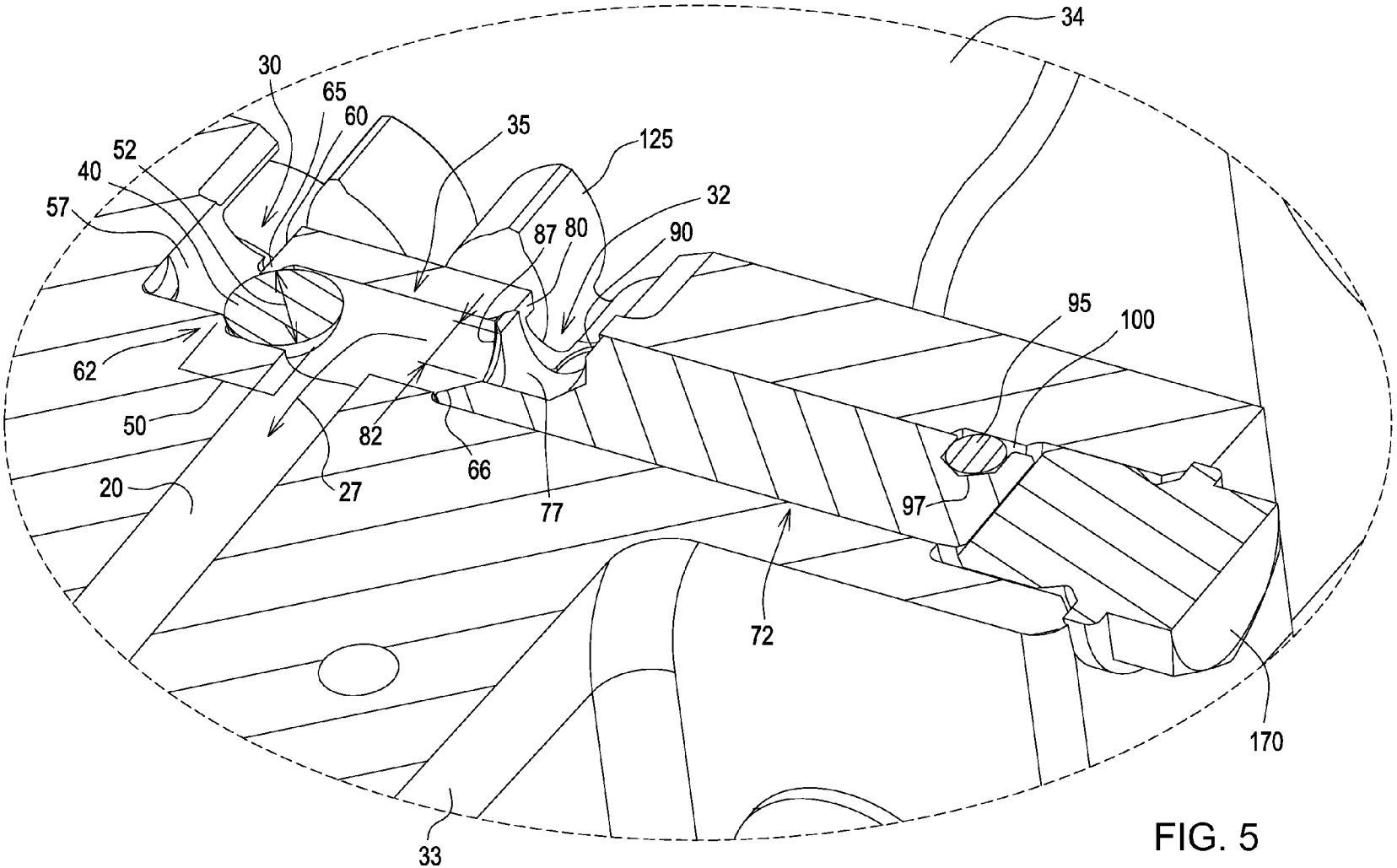
FIG. 5 is enlarged view of region 4, 5 of FIG. 3 showing the first and second passages, the junction, the first and second travel limiters, and the flow controller in a second position.
Figure 6:
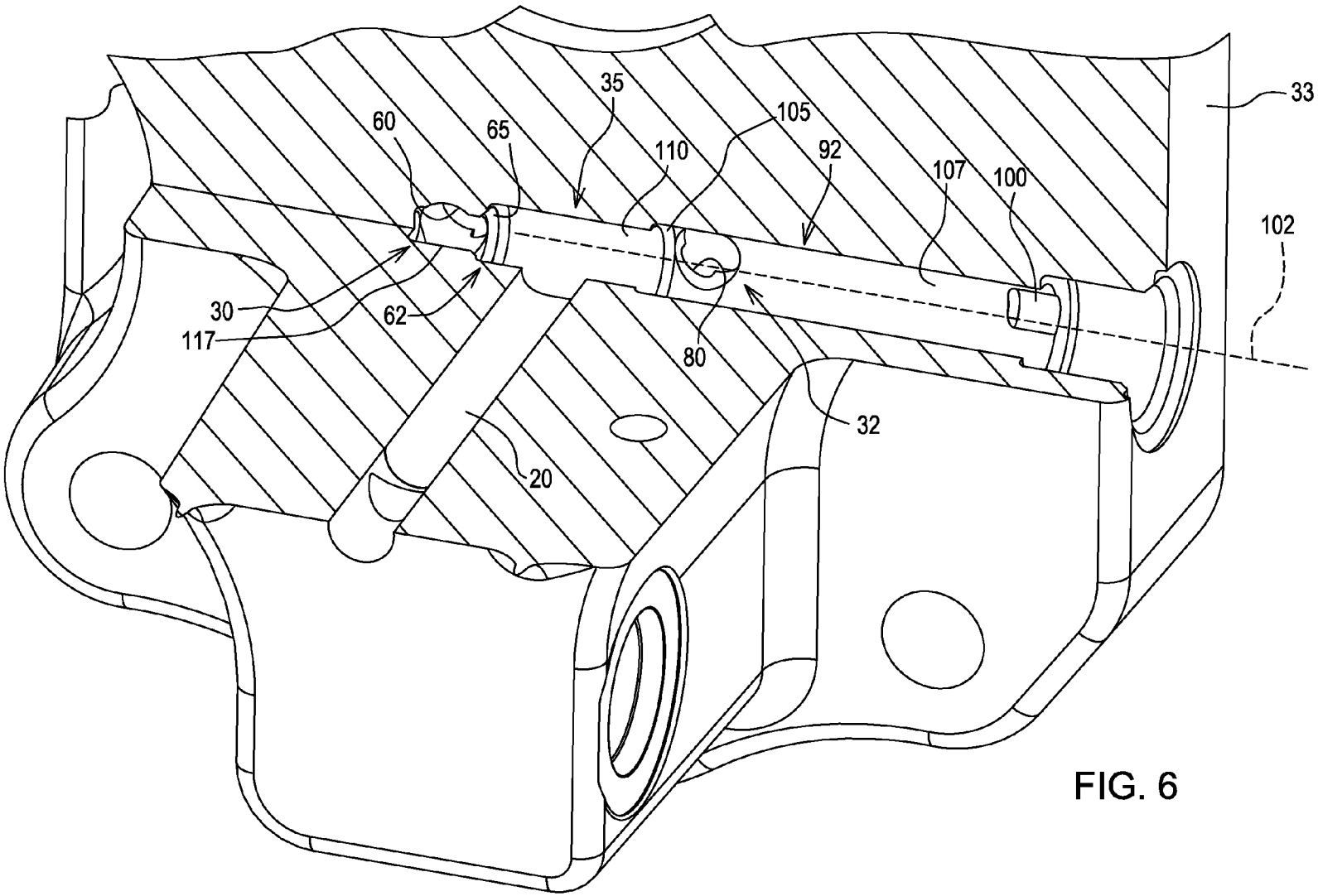
FIG. 6 is an enlarged perspective view of the pump housing, along lines 6-6 of FIG. 1 showing the first and second passages and the junction.

In the embodiment shown, if the fluid flows in the second direction 27, then the flow controller 40 is positioned, in the pump housing 17, in the second position 45 (see FIG. 5). The junction 35 fluidly connects the second passage 32 and the pump outlet 20. Additionally, this prevents the second passage 32 from being in fluid communication with the first passage 30, because the flow controller 40 and the first limiter shoulder 65 cooperate to form a seal between the first and second passages 30, 32.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

The invention claimed is:

1. A bi-directional pump, comprising:

a pump housing, the pump housing comprising a pump outlet;

a fluid pressurizer positioned in the pump housing and configured to provide fluid flow selectively in a first direction and a second direction;

a first passage positioned in the pump housing and a second passage positioned in the pump housing;

a junction fluidly positioned in the pump housing connecting the first and second passages to the pump outlet;

a flow controller positioned in the pump housing to move relative thereto between a first position placing the first passage in fluid communication with the pump outlet via the junction when the fluid pressurizer provides fluid flow in the first direction, and a second position placing the second passage in fluid communication with the pump outlet via the junction when the fluid pressurizer provides fluid flow in the second direction; and a second travel limiter distinct from the pump housing, wherein the first passage comprises:

a first passage bend;

a first passage aperture opening into the first passage bend; and a first travel limiter configured to limit the travel of the flow controller so as to space the flow controller from the first passage aperture, wherein the second passage comprises:

a second passage bend; and a second passage aperture opening into the second passage bend, the second passage bend is included in the second travel limiter, and the second travel limiter is configured to limit the travel of the flow controller so as to space the flow controller from the second passage aperture, and wherein the second travel limiter comprises:

a first limiter aperture; and a second limiter aperture, the second passage bend is positioned between the first and second limiter apertures.

2. The bi-directional pump of claim 1, wherein the flow controller is positioned on a first side of the junction when the flow controller is in the first position, the flow controller is positioned on a second side of the junction when the flow controller is in the second position, and the flow controller shuttles between the first and second positions.

3. The bi-directional pump of claim 1, wherein an outer diameter of the flow controller is greater than an inner diameter of the pump outlet.

4. The bi-directional pump of claim 1, wherein the first travel limiter is a first limiter shoulder, and an outer diameter of the flow controller is greater than an inner diameter of the first limiter shoulder.

5. The bi-directional pump of claim 1, wherein the second travel limiter comprises a second limiter shoulder having an inner diameter smaller than an outer diameter of the flow controller.

6. The bi-directional pump of claim 1, wherein the pump housing comprises a bore, the bore comprises a portion of the first passage and of the second passage and of the junction, the bore comprises the first travel limiter.

7. The bi-directional pump of claim 6, comprising a key, wherein the second travel limiter comprises a limiter keyway, the pump housing comprises a pump housing keyway and a bore, the key is positioned in the limiter keyway and in the pump housing keyway, the bore has a bore axis, the key angularly aligns the first limiter aperture with the second passage aperture relative to the bore axis.

8. The bi-directional pump of claim 6, wherein the bore comprises a stop, the bore has a bore axis, and the stop contacts the second travel limiter thereby axially aligning the first limiter aperture with the second passage aperture relative to the bore axis.

9. The bi-directional pump of claim 6, wherein the second travel limiter is positioned in the bore.

10. The bi-directional pump of claim 6, wherein the bore comprises:

a second travel limiter portion, the second travel limiter is positioned in the second travel limiter portion; and a junction portion in alignment with second travel limiter portion, the junction portion is included in the junction, a diameter of the second travel limiter portion is greater than a diameter of the junction portion.

11. The bi-directional pump of claim 10, wherein the bore further comprises a first passage portion that is in alignment with the junction portion, the junction portion is positioned between the second travel limiter portion and the first passage portion, the first passage portion is included in the first passage, and the diameter of the junction portion is greater than a diameter of the first passage portion.

12. The bi-directional pump of claim 11, wherein the flow controller is positioned in the junction portion.

13. The bi-directional pump of claim 11, wherein the junction portion and the pump outlet cooperate to form a "T" shape.

14. A bi-directional pump, comprising:

a pump housing, the pump housing comprising a pump outlet;

a fluid pressurizer positioned in the pump housing and configured to provide fluid flow selectively in a first direction and a second direction;

a first passage positioned in the pump housing and a second passage positioned in the pump housing;

a junction fluidly positioned in the pump housing connecting the first and second passages to the pump outlet; and a flow controller positioned in the pump housing to move relative thereto between a first position placing the first passage in fluid communication with the pump outlet via the junction when the fluid pressurizer provides fluid flow in the first direction, and a second position placing the second passage in fluid communication with the pump outlet via the junction when the fluid pressurizer provides fluid flow in the second direction, wherein the fluid pressurizer comprises a gear mounted to rotate relative to the pump housing about a rotation axis, the gear is positioned axially from the first and second passages relative to the rotation axis, and the gear overlaps the first and second passages axially relative to the rotation axis.

15. The bi-directional pump of claim 14, wherein the pump housing comprises:

a first radially inner recess positioned contiguously with the first passage;

a second radially inner recess positioned contiguously with the second passage, the second radially inner recess is symmetric to the first radially inner recess about a plane that encompasses the rotation axis;

a first radially outer recess positioned contiguously with the first passage; and a second radially outer recess positioned contiguously with the second passage, and the second radially outer recess is symmetric to the first radially outer recess about the plane.

16. The bi-directional pump of claim 14, wherein the pump housing comprises a cavity that is adjacent to a set of gear teeth of the gear, the set of gear teeth has an addendum radius and a dedendum radius, the cavity has a width approximately equal to a difference between the addendum radius and the dedendum radius, and the cavity extends approximately 180 degrees relative to the rotation axis.

17. The bi-directional pump of claim 16, wherein the cavity comprises a first section and a second section, the first and second sections are symmetric to one another about a plane that encompasses the rotation axis.

* * * * *